US005493380A

United States Patent [19]

Saitou et al.

[11] Patent Number: 5,493,380

[45] Date of Patent: Feb. 20, 1996

[54] FIXING DEVICE WITH MEANS FOR LIMITING A DISTANCE BETWEEN HEATING AND PRESSING MEMBER

[75] Inventors: Tooru Saitou, Yokohama; Akio Nemoto, Kawasaki; Koichi Tanigawa, Tokyo; Jun Saito, Kawasaki; Yuzo Isoda; Katsuhiko Nishimura, both of Yokohama, all of Japan

[73] Assignee: Canon Kabushiki Kaisha, Tokyo, Japan

[21] Appl. No.: 234,352

[22] Filed: Apr. 28, 1994

[30] Foreign Application Priority Data

May 11, 1993 [JP] Japan ..... 5-109350

[51] Int. Cl.[6] ..... G03G 15/20

[52] U.S. Cl. ..... 355/290; 355/285

[58] Field of Search ..... 355/282, 285, 355/290, 289, 295; 118/60; 219/216

[56] References Cited

U.S. PATENT DOCUMENTS

| | | | |
|---|---|---|---|
| 4,200,389 | 4/1980 | Matsui et al. | 355/295 |
| 4,473,290 | 9/1984 | Iwao | 355/290 |
| 4,533,231 | 8/1985 | Shigenobu | 355/295 X |
| 4,873,553 | 10/1989 | Inaba | 355/295 |
| 4,949,131 | 8/1990 | Ito | 355/282 |
| 5,138,379 | 8/1992 | Kanazashi | 355/290 X |
| 5,223,900 | 6/1993 | Yuminamochi et al. . | |
| 5,230,503 | 7/1993 | Saito et al. . | |
| 5,253,013 | 10/1993 | Takano et al. | 355/282 X |
| 5,283,621 | 2/1994 | Hashizume | 355/290 |
| 5,289,247 | 2/1994 | Takano et al. | 355/285 |

*Primary Examiner*—Sandra L. Brase

*Attorney, Agent, or Firm*—Fitzpatrick, Cella, Harper & Scinto

[57] ABSTRACT

In a fixing device, a limitation member for preventing the center distance between a heating member and a shaft of a pressing roller from being reduced does not limit the center distance in an initial state of the device, and prevents a further decrease in the distance when the distance is reduced. It is thereby possible to suppress an increase in the width of a nip portion provided between the heating member and the pressing roller, and to prevent a failure in fixing.

10 Claims, 4 Drawing Sheets

FIXING DEVICE WITH MEANS FOR LIMITING A DISTANCE BETWEEN HEATING AND PRESSING MEMBER

BACKGROUND OF THE INVENTION

1. Field of the Invention

This invention relates to a fixing device which is used in an image forming apparatus, such as a copier, a printer or the like.

2. Description of the Related Art

FIG. 8 is a diagram illustrating the schematic configuration of a conventional heating-roller-type fixing device. In FIG. 8, there is shown a heating roller 1 consisting of a releasing layer 2, a core bar 3, abd a heater 4. Also shown is a pressing roller 5 consisting of a releasing layer 6, an elastic layer 7, a core bar 8, a bearing 9, and a spring 10. Also in FIG. 8 are a thermistor 11, serving as temperature detection means, a thermoswitch 12, an entrance guide 13, a recording material 14, toner paticles 15, a separation pawl 16 and a guide 17.

The heating roller 1 comprises the core bar 3 (made of aluminum in the present embodiment) and the releasing layer 2 (in the present example, a tube made of PFA, which is a copolymer of tetrafluoroethylene and perfluoroalkylvinylether, having a thickness of 30 μm is used) formed thereon. The heating roller 1 is heated by the heater 4 provided therein. The surface temperature of the heating roller 1 is detected by the thermistor 11 provided in contact with the surface of the heating roller 1. A driving circuit (not shown) for the heater 4 is controlled so as to maintain the surface temperature of the heating roller 1 at a preset temperature.

The pressing roller 5 comprises the core bar 8 (made of SUS in the present example), the elastic layer 7 (in the present example, a silicone sponge rubber, in which a conductivity-providing agent, such as carbon or the like, is dispersed) formed thereon, and the releasing layer 6 (in the present example, a PFA tube having a thickness of 50 μm is used) formed on the elastic layer 7. The pressing roller 5 is pressed against the heating roller 1 by the spring 10 to form a nip portion.

An unfixed toner image formed on the recording material 14 is heated while being grasped and conveyed by the heating roller 1 and the pressing roller 5, and is fixed on the recording material 14 as a permanent fixed image by heat and pressure applied at the nip portion.

The heating roller 1 is rotatably driven by a motor (not shown).

The pressing roller 5 is not directly driven, but is driven by the rotation of the heating roller 1.

The recording material 14, on which the toner image has been fixed by the heat and pressure applied at the nip portion, is separated from the heating roller 1 by the separation pawl 16, and is discharged after passing through a sheet-discharging portion (not shown).

In the above-described conventional approach, however, the hardness of the pressing roller is in some cases reduced after extended use of the pressing roller, thereby causing the following problems.

(1) The position where the force of the spring urging the pressing roller toward the heating roller by the spring is balanced with the deformation restoring force of the elastic layer of the pressing roller moves closer to the heating roller as the hardness of the pressing roller is reduced. As a result, members disposed in the vicinity of the pressing roller (such as the entrance guide and the like) interfere with the pressing roller.

(2) Since the width of the nip portion increases, the position of the end portion of the nip portion changes. The entrance position of the recording material thereby shifts from an initial position, causing instability in the conveyance of the recording material.

(3) Since the width of the nip portion increases, creases are more easily produced in the recording material or an envelope being passed, and the obtained image will be more easily disturbed.

(4) Since the width of the nip portion increases, the recording material more easily deforms along the heating roller, thereby causing an increase in the amount of curl of the recording material. In addition, a failure in separation after fixing may occur, and a jam, folding and the like of the recording material at the sheet-discharging portion will more easily occur.

(5) Since the width of the nip portion increases, the amount of deformation of the pressing roller increases. Hence, a stress is applied to the pressing roller when it rotates, whereby the tube of the releasing layer will more easily peel off, and the rubber of the elastic layer will more easily deteriorate or rupture. Moreover, since the amount of deformation is large, the level of the compression set of the pressing roller increases.

(6) Since the width of the nip portion increases, the surface pressure at the nip portion is reduced. Hence, the frictional force with the heating roller or the recording material is reduced, causing instability in the rotation of the pressing roller. When the rotation moment to rotate the pressing roller by the frictional force is smaller than the frictional force between the core bar and the bearing and the force necessary to deform the pressing roller, the pressing roller does not rotate and slips.

SUMMARY OF THE INVENTION

It is an object of the present invention to prevent a failure in fixing which may occur as a result of an excessive increase in the width of the nip portion between a heating member and a pressing roller.

It is another object of the present invention to provide a fixing device including a limitation means which initially does not limit pressing by the pressing roller against the heating member, but which prevents a decrease in the distance between a heating member and a shaft of a pressing roller, as the pressing roller hardness reduces with use, beyond a predetermined minimum distance.

In accordance with these objects, there is provided a fixing device having a heating member, a pressing roller for forming a nip with the heating member, the pressing roller mounted on a shaft, urging means for urging the pressing roller against the heating member to an initial position at which the heating member and the shaft of the pressing roller are separated by an initial center distance, and a limitation means for preventing movement of the pressing roller by the urging means beyond a second position, the second position being where the heating member and the shaft of the pressing roller are separated by a predetermined minimum center distance that is less than the initial center distance.

In yet another aspect of the invention there is provided a fixing device having a frame, a heating member, a pressing roller for forming a nip with the heating member, the pressing roller mounted on a shaft and an urging means for urging the pressing roller against the heating member. To control the urging means there is provided a lever rotatable about the shaft and fixed to the frame on one side of the shaft, and a pin fixedly secured to the frame on an opposite side of the shaft at a position limiting movement of the lever, whereby a maximum amount of urging by the urging means is set.

The foregoing and other objects, advantages and features of the present invention will become more apparent from the following detalied description of the preferred embodiments taken in conjuction with the accompanying drawings.

DETAILED DESCRIPTION OF THE PREFERRED EMBODIMENTS

Figure 1:
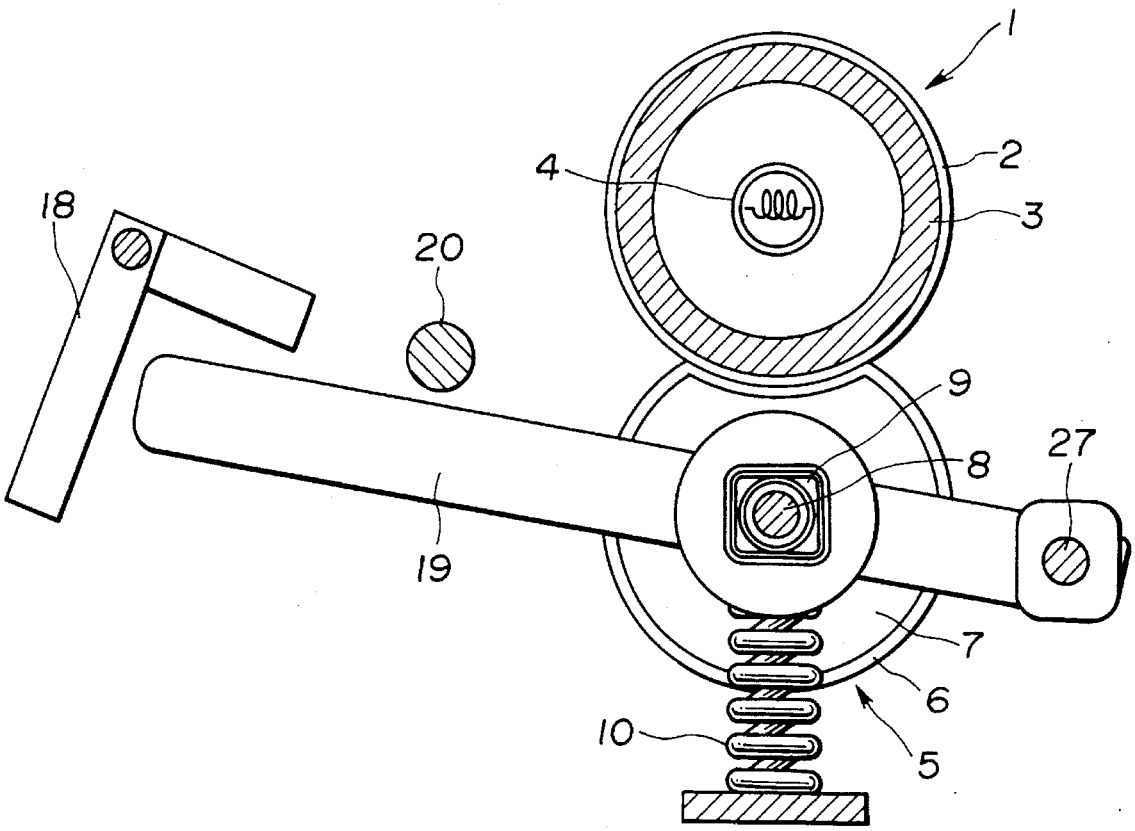
FIG. 1 is a diagram illustrating the schematic configuration of a fixing device according to a first embodiment of the present invention.

FIG. 1 is a diagram illustrating the schematic configuration of a fixing device according to a first embodiment of the present invention.

In FIG. 1, there are shown a heating roller 1, serving as a heating member, a releasing layer 2, a core bar 3, a halogen-lamp heater 4, serving as heating means, a pressing roller 5, a releasing layer 6, an elastic layer 7, a core bar (shaft) 8, a bearing 9, a spring 10, serving as a pressing means, a pressure-releasing lever 18, a lever 19, and a pin 20, the lever and pin serving as a limitation means of the present embodiment.

The heating roller 1 is heated by the halogen-lamp heater 4, and comprises the core bar 3 (made of aluminum in the present embodiment), and the releasing layer 4 (a PFA tube in the present embodiment) formed thereon. The surface temperature of the heating roller 1 is detected by a thermistor (not shown), serving as temperature detection means, disposed on the surface of the heating roller 1. A driving circuit (not shown) for the heater 4 controls the surface temperature of the heating roller 4 so as to be maintained at a preset temperature.

The pressing roller 5 comprises the core bar 8 (SUS is used in the present embodiment), and the elastic layer 7 formed thereon. In the present embodiment, a silicone sponge rubber, in which a conductivity-providing agent, such as carbon or the like, is dispersed, is used for the elastic layer 7. In order to prevent contamination of the pressing roller 5 and to reduce triboelectrification with the heating roller 1 and a recording material, the releasing layer 6 is formed on the elastic layer 7. In the present embodiment, a PFA tube having a thickness of 50 μm is used as the releasing layer 6.

In the present embodiment, the outer diameter of the heating roller 1 is 25 mm, the outer diameter of the pressing roller 5 is 25 mm, and the hardness of the pressing roller 5 is 38°–45° (ASKER C hardness). The pressing roller 5 is pressed against the heating roller 1 by the spring 10 to form a nip portion.

Figure 2:
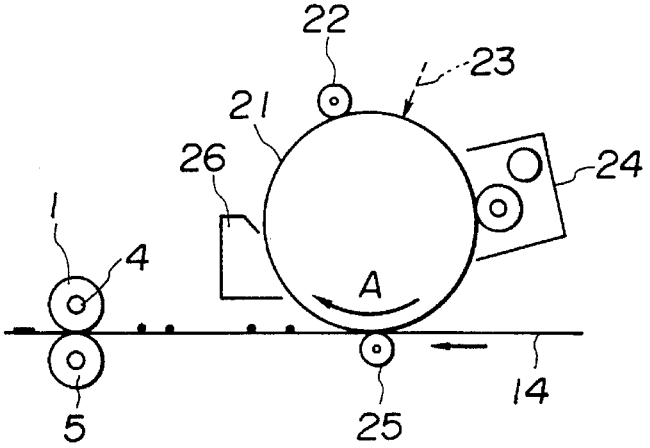
FIG. 2 is a diagram illustrating the schematic configuration of an electrophotographic image forming apparatus.

FIG. 2 is a diagram illustrating the schematic configuration of an electrophotographic image forming apparatus. In FIG. 2, a photosensitive drum 21 is rotatably driven in the direction of arrow A. A charging roller 22 charges the surface of the photosensitive drum 21. A laser light beam 23 exposes the surface of the photosensitive drum 21 to form an electrostatic latent image. A developing unit 24 develops the electrostatic latent image to form a toner image. A transfer roller 25 transfers the toner image onto a recording material 14 conveyed in contact with the photosensitive drum 21. A cleaner 28 removes toner particles remaining on the photosensitive drum 21.

The unfixed toner image formed on the recording material 14 is heated while being grasped and conveyed by the heating roller 1 and the pressing roller 5, and is fixed on the recording material 14 as a permanent fixed image by heat and pressure applied at the nip portion.

The heating roller 1 includes heating element 4 and is rotatably driven by a motor (not shown).

The pressing roller 5 is not directly driven, but is driven by the rotation of the heating roller 1.

The recording material 14, on which the toner image has been fixed by the heat and pressure applied at the nip portion, is separated from the heating roller 1, for example, by a separation pawl (not shown), and is discharged after passing through a sheet-discharging portion (not shown).

In FIG. 1, the lever 19 can rotate around a rotation shaft 27. In an ordinary state, the lever 19 does not contact the bearing 9 and the core bar 8 of the pressing roller 5.

When the recording material 14 is jammed, the pressure-releasing lever 18 depresses the lever 19, whereby the bearing 9 or the core bar 8 of the pressing roller 5 is urged downward to reduce the pressure of the pressure roller 5, so that the jam can be easily processed.

The pin 20 regulates the amount lever 19 may be raised, and is fixed, for example, to a frame (not shown) of the fixing device. The lever 19 and the pin 20, constitute limitation means for limiting the distance between the heating roller 1 and the shaft of the pressing roller 5 so that it is not reduced too much. As used herein, this distance is referred to as the center distance.

Figure 3:
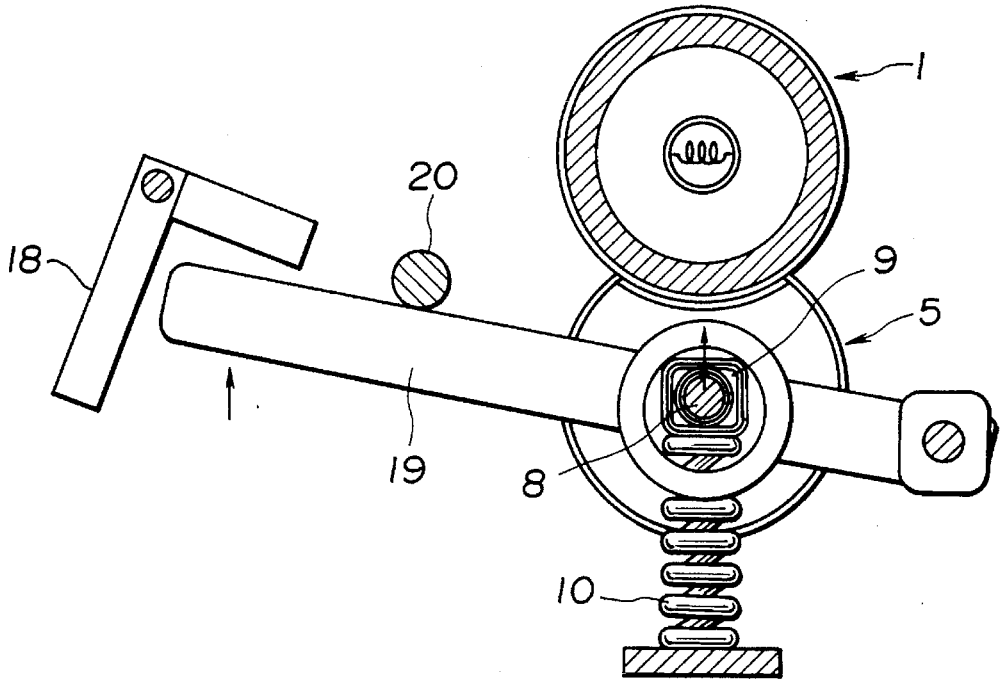
FIG. 3 is a diagram illustrating the function of limitation means used in the first embodiment.

FIG. 3 is a diagram illustrating the function of the limitation means.

In the present embodiment, the pressure of the spring 10 is 12–14 kgf.

As in the present embodiment, if a soft roller, whose elastic layer has a hardness of 38°–45° (ASKER C hardness) and a thickness of 7.5 mm, is used as the pressing roller, and a pressure of 12–14 kgf is applied, the width of the nip portion increases to about 5–6.5 mm. As a result, the amount of deformation of the pressing roller is large (about 0.5 mm–0.85 mm in the above-described conditions), and therefore the pressing roller is placed under stress. This stress causes the hardness of the pressing roller to gradually reduce while the pressing roller is used. The inventors of the present application performed durability tests, and confirmed that the hardness of the pressing roller was reduced by about 5°. That is, the hardness initially having a value of 38° was reduced to 33°, the width of the nip portion initially having a value of about 5.5 mm increased to about 7 mm, and the center distance between the heating roller and the shaft of the pressing roller was reduced.

Even in such a case, the above-described problems will not arise if the limitation means of the present invention is provided.

In an initial state of the device, the core bar 8 and the bearing 9 of the pressing roller 5 does not contact the lever 19, and an appropriate pressure is applied to the nip portion by the spring 10. If the hardness of the pressing roller 5 is reduced, and consequently, the distance between the heating roller 1 and the presssing roller 5 is reduced, the position of the bearing 9 or the core bar 8 changes, whereby the bearing 9 or the core bar 8 contacts and raises the lever 19 (either the bearing 9 or the core bar 8 contacts the lever 19 depending on the setting). However, the upward movement of the lever 19 is limited by the pin 20. Accordingly, reduction in the center distance between the heating roller 1 and the shaft of the pressing roller 5 is limited by the presence of the pin 20. Hence, the above-described problems will not arise.

The generation of a failure in the rotation of the pressing roller, which is one of the problems arising when the center distance between the heating roller and the shaft of the pressing roller is reduced, and the width of the nip thereby increases, was checked while changing the center distance. Table 1 shows the results of the check.

TABLE 1

| | Roller's hardness | | Nip width | Center distance | State of driven rotation |
|---|---|---|---|---|---|
| (1) | 43° | Free (14.4 kg) | 5.7 mm | 22.6 mm | Good |
| | | Free (9.1 kg) | 4.2 mm | 23.3 mm | Good |
| (2) | 36° | Free (13.6 kg) | 6.4 mm | 22.1 mm | Worst |
| | | Stopper 1 | 6.0 mm | 22.5 mm | Good |
| (3) | 33° | Free (12.6 kg) | 7.2 mm | 21.5 mm | Worst |
| | | Stopper 1 | 6.0 mm | 22.4 mm | Worse |
| | | Stopper 2 | 5.2 mm | 23.0 mm | Worse |
| | | Stopper 3 | 4.6 mm | 23.3 mm | Good |

When a pressing roller having a hardness of 43° was used, the nip width had a small value, and the deformation restoring force of the roller had a large value. Hence, the frictional force between the heating roller and the recording material was sufficient, and therefore a failure in the rotation of the pressing roller did not occur.

When the pressing roller having a hardness of 36° was used, the nip width was 6.4 mm without the limitation means. Hence, the surface pressure at the nip portion had a small value. In addition, the deformation restoring force of the roller has a small value because the roller is soft and therefore a sufficient frictional force could not be obtained. As a result, a failure, in which the rotation of the pressing roller stopped, occurred. However, when the nip width was maintained at 6 mm using the limitation means, no failure in the rotation of the pressing roller occurred.

When the pressing roller having a hardness of 33° was used, the nip width was 7.2 mm, and the deformation restoring force of the roller had a small value. Hence, the rotation of the pressing roller stopped. Even when the center distance between the heating roller and the shaft of the pressing roller was limited using the limitation means to obtain nip widths of 6.0 mm and 5.2 mm, rotation of the pressing roller was unstable, although a failure in the conveyance of the recording material and a failure in the obtained image did not occur. When the center distance between the heating roller and the pressing roller was limited using the limitation means so that the nip width was reduced to 4.6 mm, no failure in the rotation of the pressing roller occurred.

In the present embodiment, the distance between the axis of the heating roller and the shaft of the pressing roller (the central distance) was set to 22.4 mm, and was limited so that the nip width would not exceed 6 mm. As a result, the above-described problems could be avoided even if the hardness of the pressing roller is reduced while the pressing roller is used.

In the present invention, in an ordinary (initial) state, the central distance between the heating roller and the pressing roller is not limited by the limitation means, but is limited after extended use when the hardness of the pressing roller has been reduced. To the contrary, in a conventional fixing device in which the positions of the heating roller and the pressing roller are fixed so that the central distance between the heating roller and the pressing roller is always constant, if a pressing roller having a different hardness is incorporated, or the hardness of the pressing roller changes while the pressing roller is used for a long time period, the pressure between the heating roller and the pressing roller changes significantly even though while the nip width does not change very much.

Accordingly, when the hardness of the pressing roller is low, a sufficient fixing strength cannot be obtained because of a low pressure. On the other hand, when the hardness of the pressing roller is high, the driving torque of the fixing device increases, and creases or the like will be easily produced because of the high pressure. In the present invention, in an ordinary state, the limitation by the limitation means is not performed, and the pressing roller is pressed against the heating roller by the spring. Hence, the above-described problems will not arise.

As described above, by providing the limitation means for limiting the center distance between the heating roller and the pressing roller, the center distance is not reduced too much even if the hardness of the pressing roller is reduced while the pressing roller is used. Hence, the nip width can be limited, and the above-described problems can be avoided.

In the present embodiment, the center-distance limitation means can be configured by the pin 20 and the lever 19 only by adding the pin 20 to the pressure-releasing means comprising the lever 19 and the pressure-releasing lever 18. Hence, a very simple configuration can be obtained.

As described above, in the present embodiment, since the pressing roller does not come too close to the heating member, the pressing roller will not interefere with the members (such as the entrance guide and the like) disposed in the vicinity of the pressing roller. Moreover, since the width of the nip portion does not increase too much, the entrance position of the recording material does not shift very much from the initial designed value. Hence, the conveyance of the recording material is stabilized. Furthermore, creases, curling, a jam and folding of the recording material will seldomly occur, and the obtained image will not be disturbed. Since the amount of deformation of the pressing roller does not become too large, the durability of the pressing roller will be improved, and the level of the compression set will be reduced. Since the surface pressure of the nip portion is not reduced too much, the frictional force between the heating roller, the recording material and the pressing roller will not be reduced too much. Hence, the rotation of the pressing roller is stabilized.

Second Embodiment

Figure 4:
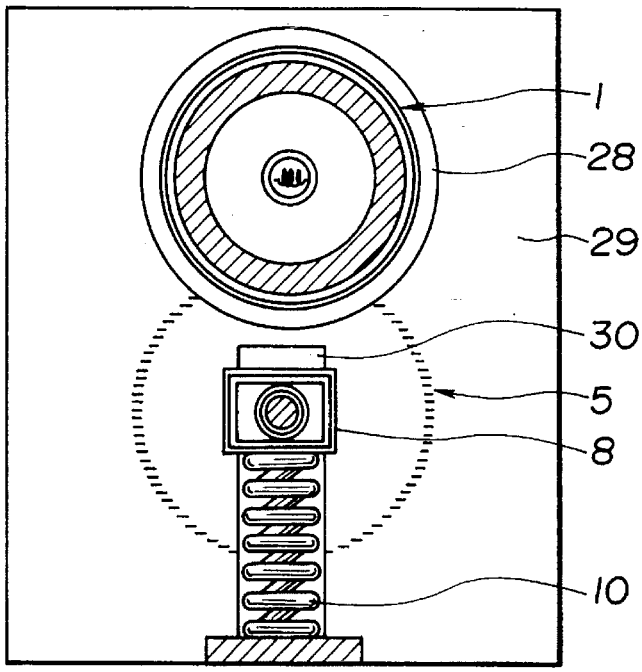
FIG. 4 is a diagram illustrating the schematic configuration of a fixing device according to a second embodiment of the present invention.

FIG. 4 is a diagram illustrating the schematic configuration of a fixing device according to a second embodiment of the present invention. A description of the same components as those in the first embodiment will be omitted.

In FIG. 4, a bearing 28 for the heating roller 1 is fixed to a frame 29 of the fixing device, which is formed by processing a sheet metal or the like. A notch 30 is opened in the frame 29. A pressing-roller bearing 8 can slidably move in the notch 30.

By limiting the length of the notch 30 (i.e., the movable range of the pressing-roller bearing 8), the center distance between the heating roller 1 and the shaft of the pressing roller 5 is limited.

Figure 5:
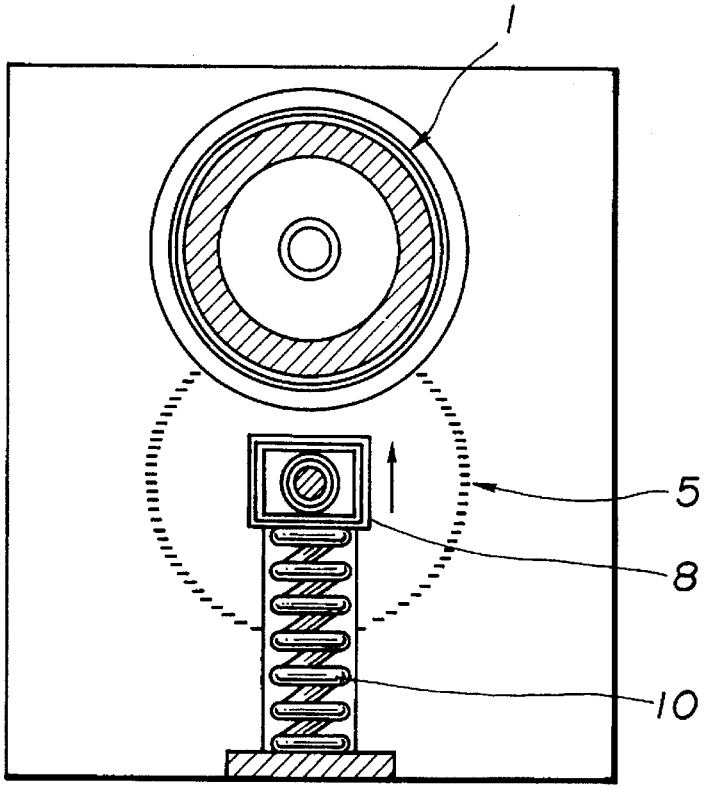
FIG. 5 is a diagram illustrating the function of limitation means used in the second embodiment.

As shown in FIG. 5, when the pressing-roller bearing 8 is raised by the spring 10 so as to reduce the center distance between the heating roller 1 and the pressing roller 5, the pressing-roller bearing 8 slidably moves in the notch 30 (when, for example, the hardness of the pressing roller 5 is reduced). However, since the length of the notch 30 is limited, the pressing-roller bearing 8 stops at the position where the notch 30 is absent, so that the center distance between the heating roller 1 and the shaft of the pressing roller 5 cannot be further reduced. Thus, the center distance between the heating roller 1 and the shaft of the pressing roller 5 can be limited. Hence, the above-described problems can be avoided.

In the present embodiment, the configuration of the means for limiting the center distance is simpler than that of the first embodiment, and therefore the limitation means can be realized at a lower cost.

Third Embodiment

Figure 6:
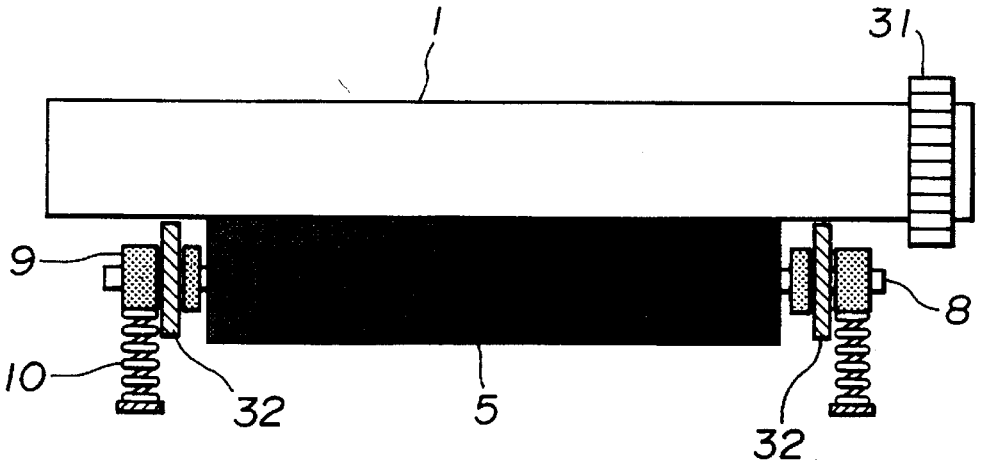
FIG. 6 is a diagram illustrating the schematic configuration of a fixing device according to a third embodiment of the present invention.

FIG. 6 is a diagram illustrating the schematic configuration of a fixing device according to a third embodiment of the present invention. A description of the same components as those in the first and second embodiments will be omitted.

In FIG. 6, a driving gear 31 is rotated by a motor (not shown), and rotatably drives the heating roller 1.

Rollers 32 are made of a heat-resistant material. In order to provide releasability, a fluororesin, such as PFA or the like, may be coated on the surface of the rollers 32. The rollers 32 are rotatably mounted on the shaft 8.

By using the rollers 32, whose outer-diameter size is limited, the center distance between the heating roller 1 and the shaft of the pressing roller 5 is limited.

Figure 7:
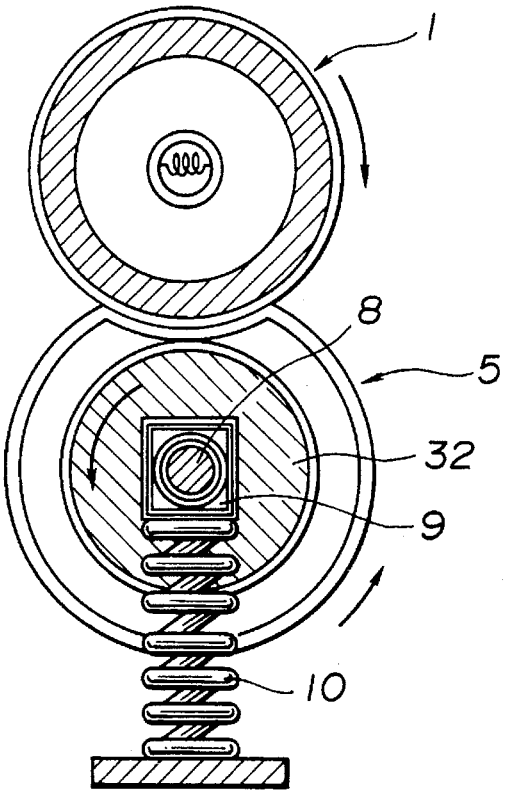
FIG. 7 is a diagram illustrating the function of limitation means used in the third embodiment.
Figure 8:
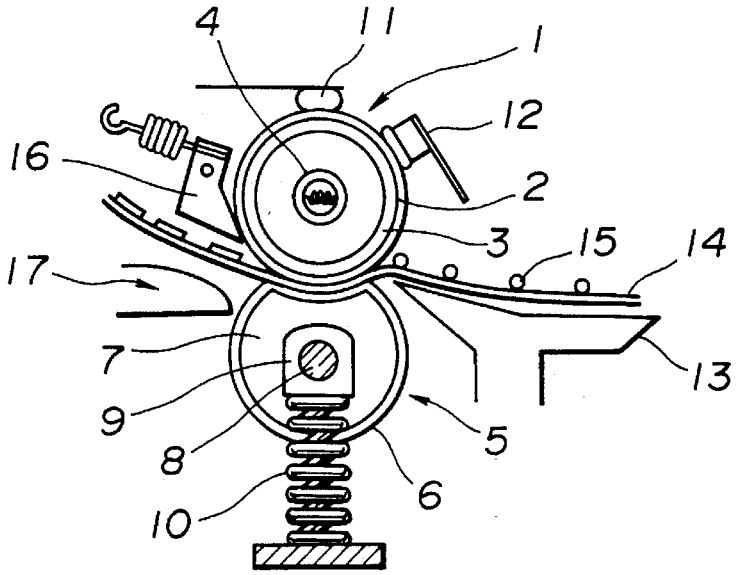
FIG.8 PRIOR ART
FIG. 8 is a diagram illustrating the schematic configuration of a conventional fixing device.

FIG. 7 illustrates a manner in which the center distance between the heating roller 1 and the shaft of the pressing roller 5 is limited. In a state in which the center distance between the heating roller 1 and the pressing roller 5 tends to be reduced, the pressing roller 5 is pressed closer to the heating roller 1 by the spring 10. However, if the pressing roller 5 approaches too close to the heating roller 1, the roller 32 contacts the heating roller 1, so that the center distance between the heating roller 1 and the shaft of the pressing roller 5 cannot be reduced further. Thus, the center distance is limited. Hence, the above-described problems can be avoided.

Since the member contacting the heating roller 1 comprises a roller, the roller also rotates as the heating roller 1 rotates. Hence, the surface of the heating roller 1 will be hardly damaged.

In the foregoing embodiments, a description has been provided of a fixing device which uses a heating roller as a heating member. However, the present invention may also be applied to a fixing device which uses a heat-resistant endless film. One surface of the heat-resistant endless film may contact the heating member, and the other surface may contact the recording material and the toner image formed thereon, so that thermal energy is supplied to the recording material and the toner via the heat-resistant endless film. A pressure may be applied to the recording material and the toner by a pressing roller, which is disposed facing the heat-resistant endless film via the recording material so as to be in pressure contact with the recording material.

Although in the above-described embodiments, a PFA coating, a PFA tube or the like is used as the releasing layer, any appropriate material other than PFA may also be used for the releasing layer.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims.

The present invention is also applicable to pressing between the heating member and the pressing roller by pressing the heating member against the pressing roller.

What is claimed is:

1. A fixing device comprising:

a heating member;

a pressing roller for forming a nip with said heating member, said pressing roller mounted on a shaft;

urging means for urging together said heating member and said pressing roller to an initial relative position at which said heating member and the shaft of said pressing roller are separated by an initial distance; and limitation means for preventing relative movement between said heating member and the shaft of said pressing roller by said urging means beyond a second relative position at which said heating member and the shaft of said pressing roller are separated by a second distance that is less than the initial distance.

2. A fixing device according to claim 1, wherein said pressing roller has a hardness equal to or less than 45°.

3. A fixing device according to claim 1, wherein said pressing roller is mounted for movement toward said heating member.

4. A fixing device according to claim 3, wherein said limitation means limits movement of the pressing roller shaft.

5. A fixing device according to claim 3, wherein said limitation means comprises a lever which is movable together with the movement of said pressing roller and a pin positioned to stop movement of the lever at a predetermined position.

6. A fixing device according to claim 3, wherein said limitation means comprises a frame of said device for limiting movement of the shaft of said pressing roller.

7. A fixing device according to claim 3, wherein said limitation means comprises a roller provided on the shaft of said pressing roller.

8. A fixing device according to claim 1, further comprising pressure releasing means for releasing pressure of said urging means.

9. A fixing device according to claim 1, wherein said pressing roller has an elastic layer.

10. A fixing device according to claim 1, wherein said heating member comprises a heating roller, and said distance is a center distance between said heating roller and the shaft of said pressing roller.

* * * * *

UNITED STATES PATENT AND TRADEMARK OFFICE

CERTIFICATE OF CORRECTION

PATENT NO. : 5,493,380
DATED : February 20, 1996
INVENTOR(S) : TOORU SAITOU, et al.

It is certified that error appears in the above-indentified patent and that said Letters Patent is hereby corrected as shown below:

COLUMN 1

Line 16, :abd" should read --and--.

COLUMN 5

Line 13, "does" should read --do--.

COLUMN 6

Line 32, "while" should be deleted.
Line 66, "seldomly" should read --seldom--.

Signed and Sealed this

Twenty-fifth Day of June, 1996

*Attest:*

Bruce Lehman

BRUCE LEHMAN

*Attesting Officer*

*Commissioner of Patents and Trademarks*